US009139267B2

(12) United States Patent
Zablocki

(10) Patent No.: US 9,139,267 B2
(45) Date of Patent: Sep. 22, 2015

(54) FLOTATION DEVICE

(75) Inventor: Joseph J. Zablocki, Lakewood Ranch, FL (US)

(73) Assignee: Joseph J. Zablocki, Lakewood Ranch, FL (US)

( * ) Notice: Subject to any disclaimer, the term of this patent is extended or adjusted under 35 U.S.C. 154(b) by 109 days.

(21) Appl. No.: 13/275,252

(22) Filed: Oct. 17, 2011

(65) Prior Publication Data

US 2012/0090521 A1 Apr. 19, 2012

Related U.S. Application Data

(60) Provisional application No. 61/394,053, filed on Oct. 18, 2010.

(51) Int. Cl.

| | |
|---|---|
| ***B63B 43/12*** | (2006.01) |
| ***B63B 43/10*** | (2006.01) |
| ***B63C 7/00*** | (2006.01) |
| *B63B 35/71* | (2006.01) |
| *B63B 43/14* | (2006.01) |

(52) U.S. Cl.

CPC ..... *B63B 43/10* (2013.01); *B63C 7/003* (2013.01); *B63B 2035/715* (2013.01); *B63B 2043/126* (2013.01); *B63B 2043/145* (2013.01)

(58) Field of Classification Search

CPC .. B63B 43/12; B63B 43/14; B63B 2059/025; B63B 2043/126; B63B 2043/145

USPC ..... 114/68, 360; 441/92–97

See application file for complete search history.

(56) References Cited

U.S. PATENT DOCUMENTS

| | | | | |
|---|---|---|---|---|
| 3,693,202 | A * | 9/1972 | Ohtani | 441/97 |
| 4,498,882 | A * | 2/1985 | Evert | 441/116 |
| 4,813,899 | A * | 3/1989 | Fujimoto | 441/122 |
| 6,066,016 | A * | 5/2000 | Yonover | 441/40 |
| 6,394,867 | B1 * | 5/2002 | Bianco | 441/126 |

* cited by examiner

*Primary Examiner* — Edwin Swinehart

(57) ABSTRACT

A self-contained emergency flotation device, the flotation device, with attached reflective material that is manual and/or automatic inflatable which is permanently, semi-permanently or temporarily mounted to a pleasure vessel, boat, canoe, kayak or personal watercraft, the vessel. The flotation device provides additional flotation, incremental buoyancy to the vessel. The flotation device includes one or more reusable flotation bladder, one or more inflators coupled to the bladder(s), one or more cartridges of compressed gas coupled to the inflator(s), one or more retention straps, a mounting mechanism, at least one backup inflator, one or more rollover strap is provided. The inflator activates to inflate one or more inflatable bladders when the flotation device is immersed in water. The flotation device remains attached to the vessel of which it is fastened. However, the temporary mounted flotation device can be reattached before and/or after inflation to assist the vessel's flotation. The rollover strap attached to the flotation device provides a hand grab(s) that can be used to roll the vessel to an upright position or used by the passenger(s) to stay with the vessel when in the water. As an integral part of the vessel, the flotation device is ready for deployment which converts a vessel into a suitable life raft type device.

8 Claims, 2 Drawing Sheets

FLOTATION DEVICE

FIELD OF THE INVENTION

The present invention generally relates to a flotation device that may be permanently, semi-permanently, or temporarily mounted to a pleasure vessel, boat, canoe, kayak, or personal watercraft.

BACKGROUND OF THE INVENTION

Today more people boat without wearing a life jacket than do. So when tragedy strikes, people have little at their immediate disposal to ensure their safely. Minimum requirement is a personal life preserver or personal flotation device, the PFD, for each person onboard. These PFDs are usually stored under a seat cushion or in a cabin, not readily accessible. In most cases tragic events happen so fast, people do not have time to locate the PFD. Leaving them in the water exposed to the elements in a semi-capsized or fully capsized vessel.

In general, people want the security of a life raft but find the life raft to be more of a nuisance; where to store them, servicing cost, etc. So the flotation device provides a unique, self-contained emergency flotation device to increase boating safety over that of a PFD and that of a life raft. Integrating flotation devices into the vessel turns the vessel into a suitable life raft type device.

SUMMARY OF THE INVENTION

In one aspect of the present invention a flotation device that includes a bladder, of least one inflator coupled to the bladder, at least one cartridge of compressed gas coupled to the inflator, at least one retention strap, a mounting mechanism, a backup inflator, and at least one strap is provided.

In another aspect of the present invention, the inflator of the flotation device may be an automatic inflator that may be activated by liquid contact, a change in pressure, or an electric trigger and the strap may include one or more loops suitable for a human hand or foot.

In another aspect of the present invention, the inflator of the flotation device may be a mechanical inflator that is activated by a mechanical trigger.

These and other features, aspects and advantages of the present invention will become better understood with reference to the following drawings, description, and claims.

DETAILED DESCRIPTION OF THE INVENTION

Figure 1:
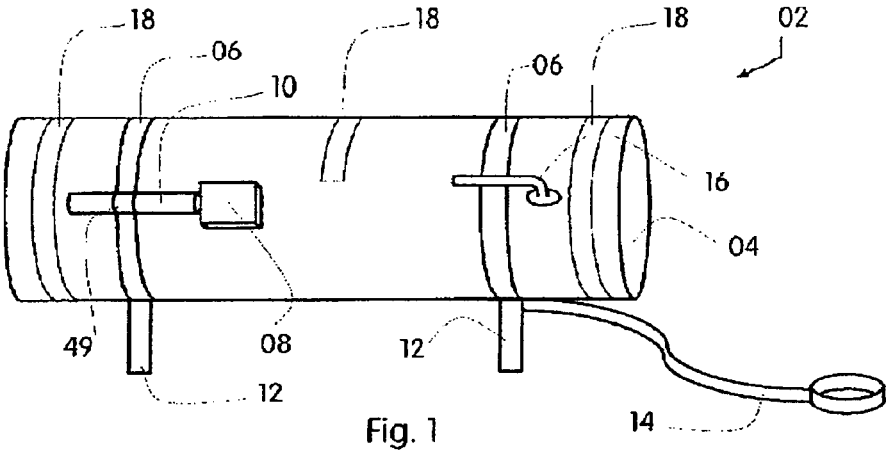
FIG. 1 illustrates one embodiment of a flotation device according to the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any of the problems discussed above or may only address one of the problems discussed above. Further, one or more of the problems discussed above may not be fully addressed by any of the features described below.

Broadly, one embodiment of the present invention generally provides a flotation device that is inflatable, either manually or automatically, that may be permanently, semi-permanently, or temporarily mounted to various types of marine vessels at various mounting locations. Those mounting locations may include but are not limited to a surface on top of, inside, or under the gunwale, inside the vessel (i.e. excluding the outside hull surface(s)), any structure above the vessel's floor that is exposed or concealed under another surface or material which provides flotation to the vessel, or any vessel opening inside the vessel's hull.

The flotation device of the present invention may provide additional flotation and incremental buoyancy to the vessel. The flotation device may be utilized with a several different types of vessels which may include but are not limited to a bass, center console, express cruise, Fish 'N Ski, flying bridge sedan, deck boats, pontoon, express fish, runabout bowrider, runabout, cuddy, tournament ski, utility, walk-around, and jon type vessel.

When a vessel takes on water or is capsized due to water egress, the vessel may sink, float upside down, or float bow up providing little if any support to sustain human life until rescue. In heavy seas it is nearly impossible to stay with the vessel while waves and winds pound the vessel as passengers float alongside. Due to the vessel's size, water forces exerted by the submerged structure, and the lack of leverage it is almost impossible for passengers in the water to roll the marine vessel upright. While passengers are stranded in the water, hypothermia may also become an issue before a successful rescue is made because a capsized vessel floating upside down provides little access to stored safety gear, food, water, emergency signaling equipment, etc. to assist passengers in survival and rescue.

When one or more flotation devices, such as but not limited to a tower structure, coaming pads, or any above deck structure or compartments, are placed above a vessel's floor, the device's buoyancy may create enough force to assist in rolling the marine vessel on its side or fully upright. Existing inflatable devices may be attached to the exterior hull of a vessel, but these devices require the manufacturer to modify the hull during the manufacturing process to incorporate such devices. Other vessel manufacturers may use rigid flotation material such as foam between their deck(s) and hull which provides some flotation. However, the flotation is not adequate to completely float the vessel and there is no device(s) to assist the passenger(s) in rolling the vessel over, upright.

Therefore, there is a need for a flotation device that requires no modification to a vessel's hull and may be an add-on device. Furthermore, incorporation of rollover straps may assist passengers in rolling a capsized vessel. Once upright, the vessel may be used as a life raft for passengers and they may also reenter the vessel to gain access to safety gear, food, water, emergency signaling equipment as well as limit the possibility of hypothermia.

As illustrated in FIG. 1, the flotation device 02 of the present invention may include a bladder 04. The bladder 04 may be shaped as a cylinder or as other shapes such as but not limited to a cone, sphere, hemisphere, cube, elongated cube, cylinder, pyramid, triangular prism, rectangular prism, pentagonal prism, hexagonal prism, octagonal prism, or any other polyhedron prism. The bladder 04 may be comprised of any air-tight material known in the art of inflatable devices, including but not limited to all inflatable materials, fabrics or coated fabrics such as PVC or PVC/PU coated nylon. The bladder material may also be resistant to punctures by sharp objects. The bladder may include one or more self contained chambers or one or more chambers with one-way valves which may allow gas to fill each chamber.

The flotation device 02 may have one or retention straps 06 which may be external or internal to the bladder 04 or as part of the bladder 04 material itself. The retention straps 06 may provide the connection between the flotation device 02 and the vessel. The retention straps 06 may be made of suitable material to handle the mechanical forces and environmental elements that a marine vessel may encounter. Such material may include but is not limited to webbing, enforced materials, or structural fabrics. The retention straps 06 may be attached to the bladder 04 at one or more bladder seams external to the air-tight vessel created by the bladder 04 or as part of the bladder 04 itself. The retention straps 06 may be flexible and pliable so that they can be folded as required.

One or more inflators 08 may deliver an inflating gas to the bladder 04 in an automatic or manual mode. The automatic mode may include, but is not limited to, contact with liquids, increase in pressure, electronic trigging, or a combination of liquid, gas, and/or pressure methods. Some embodiments may also have electronic activated sensors and/or monitoring sensors that could automatically activate the flotation device 02 and/or send information of activation to a vessel monitoring system to notify passengers of the flotation devices' current status. In some cases, premature activation in automatic mode could occur during wash down, cleaning, rain, or water spray on the vessel. To prevent this, the bladder 04 may be wrap-folded in order to create a cocoon around the leading, top, and front edges to direct liquid away from the inflator 08. The manual mode may require an external mechanical activation, movement, or electronic trigging event to dispense the inflating gas. The inflator 08 may be mounted to the bladder 04 in any location with an airtight seal. In addition, the inflator 08 may be mounted external from the flotation device 02 for various applications.

One or more custom cartridges 10 of suitable size and volume may be attached to the flotation device 02 to deliver the required inflation gas to the bladder 04. The cartridge 10 may be an enclosed vessel which contains compressed gas that is connected to the inflator 08. The cartridge 10 may be connected to the inflator 08 using a screw, bayonet, slide and clip mount, or other similar methods. The cartridge 10 may have a cylindrical or oval cylindrical profile may be 1 to 2.5 inches in diameter and 8 inches or longer. The cartridge 10 may also be wider in diameter and shorter or longer based on the design of the flotation device.

Each retention strap 06 may have a mounting mechanism 12 to connect the flotation device 02 to the vessel. The mounting mechanisms 12 may include but are not limited to eyelets, screws, bolts & nuts, helical & threaded inserts, rivets, threaded rods & studs, U-Bolts, shim clips, pins, anchors, mails, staples key stocks, retaining rings, cable ties, hook & loop, buckles, snaps, or adhesives.

The flotation device 02 may also have one or more straps 14 which are external to the bladder. The straps 14 may be mounted to the retention straps 05 or as part of the mounting mechanism 12 or on its own external mount. The strap 14 may be of suitable length and material to handle the mechanical forces and environmental elements a marine vessel may encounter. Each strap 14 may also have one or more loops suitable for a human hand or foot hold.

One or more backup inflators 16 may deliver an inflating gas to the bladder 04 as an alternative method of inflating the bladder 04. The backup inflator 16 may be mounted to the bladder 04 in any suitable location based on the bladder's 04 style and mounting location using an air-tight seal. In addition, the backup inflator 16 may be mounted external from the flotation device 02 for various applications.

The reflective material 18 may be made of suitable material that reflects light and radar using industry standard materials. One or more reflective materials 18 may be coupled to the bladder 04, retention strap 06, or as an independent element. The reflective material 18 may be any shape such as but not limited to strips, patches, rectangles, circles, ovals, polygons, or any subset, combination of, or partial shape implementation.

Figure 2:
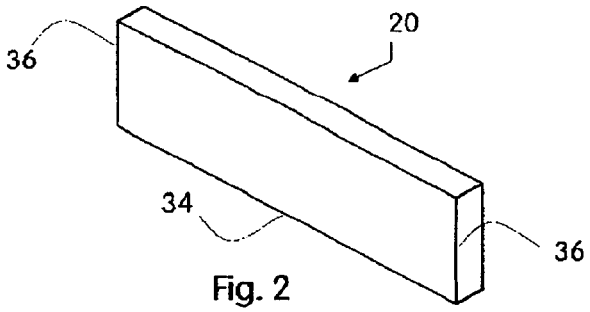
FIG. 2 illustrates one embodiment of coaming pad for storing a flotation device according to the present invention.
Figure 4:
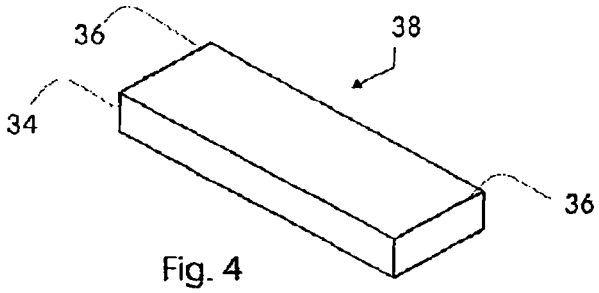
FIG. 4 illustrates one embodiment of a universal rigid flotation device according to the present invention.
Figure 6:
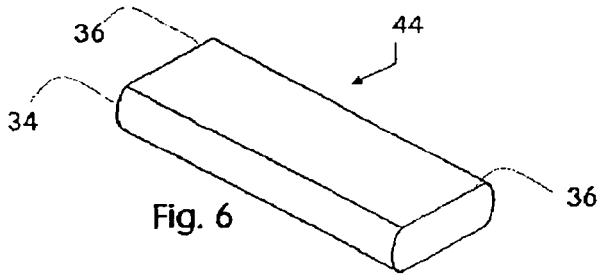
FIG. 6 illustrates one embodiment of a universal soft flotation device according to the present invention.

The flotation device 02 may also be configured into several forms such as but not limited to a coaming pad flotation device 20, a universal rigid flotation device 38, or a universal soft flotation device 44 as illustrated in FIG. 2, FIG. 4, and FIG. 6, respectively. The coaming pad flotation device 20 may allow for immediate deployment for adding incremental flotation to the vessel's cockpit area where most of the vessel's weight is and where the passengers may be during an emergency event.

Figure 3:
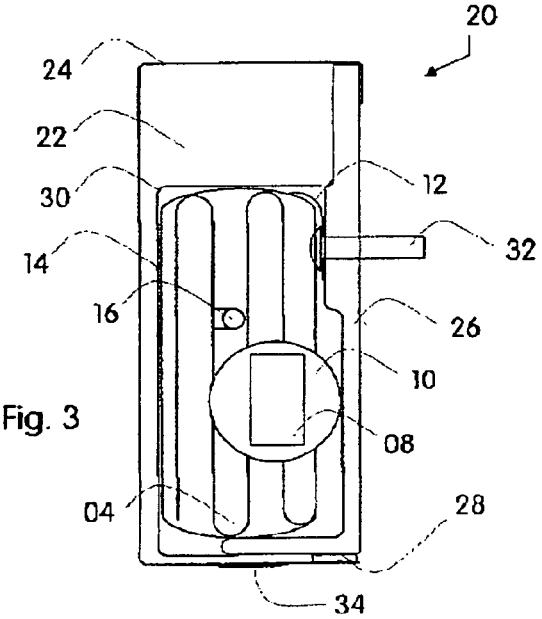
FIG. 3 illustrates a flotation device that is stored within the coaming pad of FIG. 2.

As illustrated in FIG. 2, the flotation device 02 may be packaged inside a vessel's coaming pad so that it is concealed to retain the vessel's style and function. As illustrated in FIG. 3, a soft cover 24 may enclose the flotation device 02 and may be made of industry standard materials for coaming pads such as but not limited to vinyl, marine-grade vinyl, poly/vinyl, UV treated materials, Supplex, taffetta, coated-nylon, naugahyde, nautolex marine vinyls, canvas, morbern, enduratex, foam backed vinyl, pleated vinyl, sante fe suede, 100% vinyl, or nylon fabrics such as cordure, oxford cloth, pack cloth, or rip stop. The soft cover 24 may use welt cording on seams between soft cover 24 panels. A removal seam closure 36 may be used as required on each end of the coaming pad flotation device 20 so that the soft cover 24 may open during activation of the flotation device 02. Velcro™, breakaway stitch seam, staples, or any hook and loop closure device may be used as a seam closure 36 but are not limited to these methods or devices.

The soft cover 24 may include one or more ventilation openings 34. The ventilation openings 34 may be a simple opening in the soft cover 24 material, opening with reinforced edges of stitching, a grommet, a grommet with screen, or any other device that allows a ventilation opening 34 into the coaming pod's internal cavity. The ventilation openings 34 may be located on the bottom side of the soft cover 24 but may be located at any suitable location.

The inside cavity may be filled with padding 22 which is of industry standard materials such as medium to high density polyfoams that are either open, closed, or quick drain cell foam designs. The protective cover 30 may be a flexible polymer, a protective coaming on the padding 22, or a rigid polymer that may protect the flotation device 02 while in its non-active state. The protective cover 30 may be of various lengths and may have openings or voids in the material for ventilation into the internal cavity.

The mounting plate 26 may be made of a suitable polymer material to provide support for the coaming pad flotation device 20 and its components. One or more retention devices 28 made of but not limited to Velcro™, breakaway stitch seams, or any hook and loop closure device may be located on the coaming pad flotation device 20 flap opening.

As illustrated in FIG. 4, a universal rigid flotation device 38 may have a similar package as the coaming pad flotation device 20 without the padding. The universal rigid flotation device 38 may also have a smaller profile for different vessel mounting locations.

Figure 5:
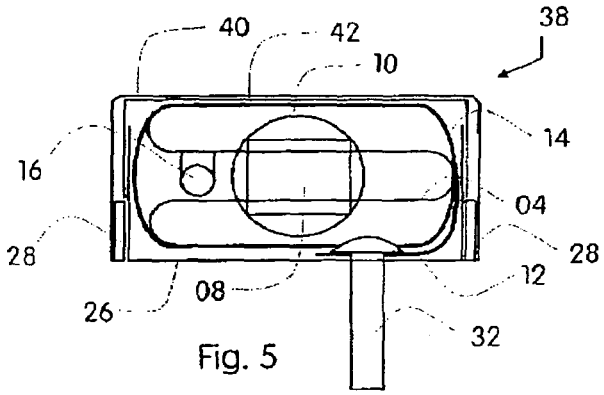
FIG. 5 illustrates a flotation device that is stored within the universal rigid flotation device of FIG. 4.

As illustrated in FIG. 5, a hard/soft cover 40 can be of a soft cover or of a semi-rigid or rigid polymer material with breakaway devices to allow the hard/soft cover's 40 removal during activating of the flotation device 2. The protective cover 42 may be required when using a soft cover material. The hard/soft cover 40 may also provide protection from the environmental elements surrounding the flotation device 02 and protect against premature inflations.

The protective cover 42 may be a flexible polymer, a protective coaming on the soft cover, or a rigid polymer to protect the flotation device 02 while in its non-active state. This protective cover 42 may be of various lengths and may have openings or voids in the material for ventilation into the internal cavity.

The mounting device 32 may be internal as shown in FIG. 5 or external to the universal rigid flotation device 38 envelope. This may allow for different mounting locations within a vessel.

As illustrated in FIG. 6, a universal soft flotation device 44 may allow for the most flexibility in mounting locations and vessel types using a semi-permanent or temporary mounting method.

Figure 7:
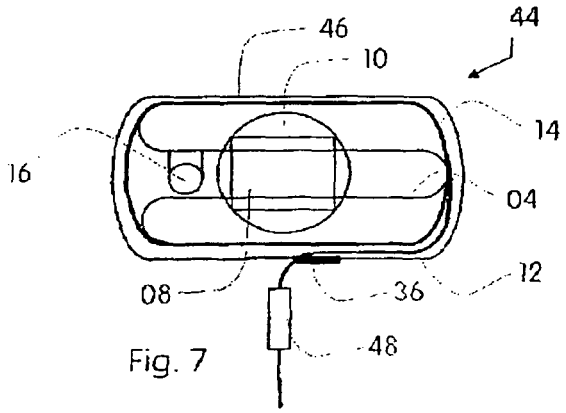
FIG. 7 is illustrates a flotation device that is stored within the universal soft flotation device of FIG. 6.

As illustrated in FIG. 7, a soft cover 46 may enclose the flotation device 02 and may be made of industry standard materials for marine upholstery as described above. The soft cover 46 may use welt cording on seams between softer cover 46 panels. A removal seam closure 36 may be used as required, and may be on each end of the universal soft flotation device 44 to allow the soft cover 46 to open during activation of the flotation device 02. Velcro™, breakaway stitch seam, or any hook and loop closure device may be used as a seam closure 36 but are not limited to those methods or devices.

The soft cover 46 is shown in FIG. 7 as an individual component of the universal soft flotation device 44, however it can be part of the bladder 04, as well. The mounting mechanism 12 may exit the soft cover 46 at any location, however the bottom side along the longitudinal axis or side is may provide a better location for mounting on a vessel.

The mounting device 48 may be a buckle or may include any of the above described mechanisms to connect the universal soft flotation device 44 to the vessel. A buckle may be made of steel, plastic, or other polymers or metals such as but not limited to feed-through adjusting plates, a spring-loaded clamp, hinged-bar, cam, quick-tight, or squeeze-release which may be sew-on or no-sew.

The embodiments described above by reference to FIG. 1-FIG. 7 may be combined using various connection means. These connection may include any known connectors such as eyelets, screws, bolts & nuts, bolts helical & threaded inserts, rivets, threaded rods & studs, U-Bolts, Shim Clips, pins, anchors, mails, staples, key stocks, retaining rings, cable ties, hook & loop, buckles, snaps, sewing seams, or adhesives. The connection may also be made using any other industry standard methods for the materials used, such as RF welding, chemical bonding, etc. RF welding is also known as RF sealing, radio frequency welding, dielectric bonding, dielectric interface, dielectric sealing, dielectric welding, dielectric heat sealing, dielectric interface, electronic heat sealing, high frequency welding, high frequency sealing, HF sealing, HF welding, induction heating, bar sealing, blister sealing, blister welding, clam shell sealing, custom RF welding, custom RF sealing, electronic heat sealing, industrial sealing, industrial welding, low dielectric welding, medical radio frequency sealing, package heat sealing, package sealing, plastic sealing technology, PVC welding, and RF bonding.

The inflator 08, backup inflator 16, and reflective materials 18 may be connected to the one or more bladder panels in a location that is accessible to user from inside the vessel or when floating alongside the vessel. These elements may also be coupled to the bladder 04 with RF welding. The bladder panels may be bonded with RF welding to each other on the outer peripheral edge to create the design shape for the flotation device 02 and an air-tight seal. Reinforcement between bladder panels may be in the form of sewing seams external to the RF welding seam. Industry standard thread may be used for this connection.

The cartridge 10 may connect to the inflator 08 via an industry standard connection such as screw, bayonet, or slide and clip mount methods. The cartridge's 10 body may be held in place by a loop 49 located on the retention strap 06. The retention straps 06 may be connected to the bladder 04 on the outer edge of the bladder 04 external to the RF welding seam. When the retention straps 06 are part of the bladder material, no connection is required between these two components.

The mounting mechanism 12 may be connected to the mounting plate 26 using an industry standard method via one or more openings in the retention straps 06. The retention straps 06 may have enough scope to make the connection and allow the flotation device 02 to swing freely and unobstructed from the mounted surface. The strap 14 may be connected to either the retention straps 06, the mounting mechanism 12, or an external mount. When connected to the retention strap 06 a sewing seam may be used.

In the coaming pad flotation device 20 or the universal rigid flotation device 38 configuration, the flotation device 02 may connected to the mounting plate 26 via the mounting device 32 using a bolt and nut method, for example. The mounting device 32 may be long enough to mount the coaming pod flotation device 20 or the universal rigid flotation device 38 to the vessel using a nut-lock washer method.

The padding 22 may be connected to the inside surface of the soft cover 24 using adhesive. The soft cover 24 may be connected to the mounting plate 26 using staples, for example, which may provide a secure connection that enables proper use of the coaming pad during normal operation. The protective cover 30 may be connected to (1) the mounting plate 26 using one or more mechanical clips, (2) the padding using adhesive, or (3) it may be a spray-on material to the padding 22.

The retention devices 28 may be connected to the mounting plate 26 with staples, adhesive, and/or other industry standard methods used in upholstering. In addition, the retention devices 28 may be connected to the soft cover 24 with sewing seams and/or adhesive. Any mechanical ventilation opening 34 may be connected to the soft cover using a pressure fix, adhesive, mechanical clamp, crimp or other industry standard method. The seam closure 36 may be applied using a sewing seam, adhesive and/or other industry standard method as well.

In the universal rigid flotation device 38 device, the retention device 28 may also be connected to the mounting plate 26 using staples, adhesive, and/or other industry standard methods used in upholstering. In addition, the retention device 28 may be connected to the hard/soft cover 40 with sewing seams and/or adhesive.

The protective cover 42 may be connected to (1) the mounting plate 26 using one or more mechanical dips, (2) the hard/soft cover 40 using adhesive or (3) is a spray-on material to the hard/soft cover 40.

For the universal soft flotation device 44, all previous connections apply with the following changes. The soft cover 46 may be sewn, RF welded, or adhered to the bladder 02. In addition, the mounting device 48 may be a buckle which is sewn-on or not sewn onto the retention strap 06.

Use of the various flotation devices described above will now be explained. One or more flotation devices 02 may be secured to a vessel to provide incremental flotation to the vessel. Each flotation device 02 can be inflated using the automatic function of the inflator 08, the manual function of the inflator 08, or the backup inflator 16. When the vessel is taking on water and is in the normal floating position, hull side down and in the water, the manual inflation method may be used to assist in preventing the vessel from rollover. When the vessel rolls over and is capsized, the inflator's 08 automatic function may inflate each flotation device 02.

Upon activation of the inflator 08, compressed gas from the cartridge 10 may be expelled into the bladder 04 filling it with gas. While the bladder 04 is inflating, the force may open any of the flotation devices 02 packaging including but not limited to the coaming pod flotation device 20, the universal rigid flotation device 38, or the universal soft flotation device 44, allowing the bladder 04 to fully inflate. The inflated bladder 04 is connected to the vessel via the one or more mounting mechanisms 12 and mounting devices 32 & 48. This allows the flotation devices' 02 buoyancy forces to transmit to the vessel. In some mounting locations the flotation devices' 02 buoyancy forces may be transmitted to the vessel via the bladder with contact to the vessel's structure. In this case, the mounting mechanisms 12 and mounting devices 32 & 48 may hold the flotation device 02 in position. Fully inflated, the flotation devices 02 may increase the vessel's ability to stay afloat when taking on water.

Based to the flotation devices' 02 mounting locations, the leverage distance from the surface, and the flotation devices 02 upward buoyancy force, the flotation devices may create a rolling force to place the vessel on its side or fully upright. When on its side, the straps 14 may be used to help roll the vessel to a full upright position.

The inflator 08 may be an industry standard device which operates on water contact and/or water pressure and/or electrical activation for the automatic method of operation. This water includes all types but not limited to saltwater, freshwater or brackish water. One manual method may also include a rip cord pull method to activate the cartridge 10.

The backup inflator 16 may be used to initially inflate the flotation device 02 or used to refill the bladder with gas. The backup inflator 16 may be an industry standard device which requires a human blowing air into the bladder 04 via the backup inflator 16. The reflective material 18 on the bladder 04 may also provide identification at day or night for light and radar search methods.

Once a flotation device 02 is deployed. It may also be repackaged and rearmed for continued service. A temporarily mounted flotation device 02 may also be repositioned before or after inflation to secure the vessel's stability in comprising situations. If the flotation device is removed altogether by cutting the retention strap 06 free from its mount or unbuckling the flotation device 02, it may be used as a personal flotation device independent of the vessel or a flotation element of a raft or vessel. Furthermore, the flotation device 02 may also be used as a lifting element by connecting the retention straps 06 to the object or by placing the flotation device 02 under the object to be lifted.

It should be understood, of course, that the foregoing relates to exemplary embodiments of the invention and that modifications may be made without departing from the spirit and scope of the invention as set forth in the following claims.

I claim:

1. A flotation device, which is a self-contained emergency flotation device, comprising: a bladder, an inflator coupled to the bladder, a cartridge coupled to the inflator for delivering compressed gas to the bladder, at least one retention strap coupled to the bladder, a mounting mechanism coupled to the at least one retention strap for mounting the flotation device to a vessel, a backup inflator for use in manual inflation of the bladder, at least one reflective material coupled to the bladder, and a rollover strap comprising a loop suitable for a human hand or foot coupled to the flotation device, wherein the flotation device is constructed into a vessel coaming pad flotation device further comprised of a soft cover which encapsulates the flotation device, padding coupled to the inside of the soft cover, a retention device, a mounting plate supports the padding, couples the retention strap to the mounting mechanism and couples the retention device to the soft cover, a protective cover between the soft cover and the bladder protecting the bladder from puncture, a mounting device connecting the vessel coaming pad flotation device to the vessel, a ventilation opening coupled to the soft cover, and a breakaway seam closure on the soft cover.

2. The flotation device of claim 1 wherein the bladder includes a plurality of chambers with a one-way valve between said chambers which allows gas to fill each said chamber in a size and volume configuration suitable for the application.

3. The flotation device of claim 1 wherein the inflator is automatic.

4. The flotation device of claim 1 wherein the inflator is manual, active by external mechanical activation, movement, or electronic trigging event to dispense the Inflating gas.

5. The flotation device of claim 1 wherein the inflator is automatic and manual, active by external mechanical activation, movement, or electronic trigging event to dispense the inflating gas.

6. The flotation device of claim 1 wherein the retention strap has a loop to retain the cartridge.

7. The flotation device of claim 1 wherein the bladder is wrap-folded in order to prevent premature activation of the inflator.

8. The flotation device of claim 1 wherein the flotation device is permanently or temporarily mounted to the vessel.

* * * * *